US008920055B2

(12) United States Patent
Shibasaki et al.

(10) Patent No.: US 8,920,055 B2
(45) Date of Patent: Dec. 30, 2014

(54) PRINTER DEVICE AND METHOD FOR CONTROLLING CUTTING POSITION OF BOARDING PASS

(75) Inventors: Mitugu Shibasaki, Maebashi (JP); Katsuyuki Hiroki, Maebashi (JP); Masahiko Kibe, Maebashi (JP); Makoto Kurihara, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 1105 days.

(21) Appl. No.: 12/411,171

(22) Filed: Mar. 25, 2009

(65) Prior Publication Data

US 2009/0245914 A1 Oct. 1, 2009

(30) Foreign Application Priority Data

Mar. 28, 2008 (JP) ..... 2008-088500

(51) Int. Cl.
*B41J 11/70* (2006.01)
*G07B 1/00* (2006.01)
*G07B 5/02* (2006.01)

(52) U.S. Cl.
CPC ... *G07B 5/02* (2013.01); *G07B 1/00* (2013.01)
USPC ..... 400/621

(58) Field of Classification Search
CPC ..... G07B 1/00; G07B 5/02
USPC ..... 400/621
See application file for complete search history.

(56) References Cited

U.S. PATENT DOCUMENTS 4,716,799 A 1/1988 Hartmann
4,928,133 A 5/1990 Fulton
4,981,059 A * 1/1991 Kobayashi ..... 83/76.7
5,133,615 A * 7/1992 Saito et al. ..... 400/621
5,890,708 A 4/1999 Song
6,129,462 A 10/2000 Furuya et al.
2007/0138281 A1 * 6/2007 Moriyama et al. ..... 235/451

FOREIGN PATENT DOCUMENTS

| | | |
|---|---|---|
| EP | 0 416 795 | 3/1991 |
| EP | 0 475 625 | 3/1992 |
| GB | 2 001 909 | 2/1979 |
| JP | 7-246738 | 9/1995 |
| JP | A 9-191731 | 7/1997 |
| JP | 10-000827 | 1/1998 |
| JP | 11-003442 | 1/1999 |
| JP | A 2002-36654 | 2/2002 |

OTHER PUBLICATIONS

Notice of Rejection Grounds mailed Aug. 7, 2012, from corresponding Japanese Patent Application No. 2008-088500 (with partial English translation).

* cited by examiner

*Primary Examiner* — Christopher Stanford
(74) *Attorney, Agent, or Firm* — Greer Burns & Crain Ltd.

(57) ABSTRACT

A proposed printer device drives a conveyance unit to forward the end position of a medium by an amount of feed corresponding to a first boarding pass length from a cutting position, moves a cutter up and down to attempt a cutting operation. When the cutting operation is successfully performed, the boarding pass length of one boarding pass of a series of boarding passes to be processed is set as the first boarding pass length. When the cutting operation is unsuccessfully performed, the conveyance unit is driven to forward the end position of the medium by an amount of feed corresponding to the difference between the first boarding pass length and a second boarding pass length longer than the first boarding pass length, and the cutting operation is attempted again by moving a cutter up and down in the cutting position.

6 Claims, 10 Drawing Sheets

PRINTER DEVICE AND METHOD FOR CONTROLLING CUTTING POSITION OF BOARDING PASS

BACKGROUND OF THE INVENTION

1. Field of the Invention

The present invention relates to the technique of controlling the cutting position of a boarding pass on a printer device for issuing an aircraft boarding pass.

2. Description of the Related Art

A printer specifically for issuing a boarding pass and a ticket, and a printer specifically for printing a baggage tag are used in the airline industry. In the industry, there has been a request to print a boarding pass and a ticket on a printer specifically for printing a baggage tag with a view to attaining higher efficiency and realizing cost reduction, and the practical operation of the printer has been started.

The length of one boarding pass or ticket can be (7+3/8) inches or 8 inches. Some boarding passes and tickets have marginal portions called stubs in addition to the bodies of the boarding passes, and there are also two types of printing patterns depending on the length of one boarding pass or ticket.

There are the following two functions of printers required to realize the above-mentioned practical operation.

Function of cutting a sheet depending on the length of one boarding pass (ticket) from a set of medium Function of automatically selecting the appropriate printing pattern for the length of one set boarding pass (ticket)

To realize the above-mentioned two functions, a sensor for detecting a notched portion as a joint between a stub and a ticket or between tickets is currently mounted as a mechanical configuration, thereby causing a cost increase.

On the other hand, the printer specifically for printing a baggage tag is not loaded with the sensor for detecting a notched portion as a joint between a stub and a ticket or between tickets. Therefore, when the device is set (software switch etc.), one boarding pass (ticket) length is user set or host-instruction set, and the subsequent processes are performed on the basis of the set one boarding pass (ticket) length.

However, since the one boarding pass (ticket) length in the set medium is not automatically recognized, for example, the following problem occurs.

That is, there is the problem that characters etc. cannot be printed in the right positions by an erroneous operation of, for example, performing specification for a boarding pass having no stub on a boarding pass having a stub.

As similar techniques, for example, the patent document 1 discloses a print system for automatically detecting the length of a fed sheet, and performing a printing operation.

In addition, the patent document 2 discloses a printer system for reading any number of documents processed in financial institutions by an image reader, and determining whether or not the read data can be printed on a printer.

[Patent Document 1] Japanese Laid-open Patent Publication No. 9-191731 "Print System for Automatically Detecting Sheet Length and its Control Method"

[Patent Document 2] Japanese Laid-open Patent Publication No. 2002-36654 "Printer System"

SUMMARY OF THE INVENTION

The present invention aims at providing a printer device capable of automatically controlling the cutting position depending on the boarding pass length of one boarding pass of a series of boarding passes, which is not loaded with the sensor for detecting a notched portion as a joint between a stub and a ticket or between tickets, and a cutting position control method of a boarding pass.

A proposed first printer device performs printing and cutting for each boarding pass from a series of boarding passes as a medium.

The first printer device includes: a cutting unit for attempting to cut a medium by a cutter at a potential position of a joint between boarding passes in a cutting operation performed before a printing process; and a control unit for driving the cutting unit to attempt to cut the medium at the next potential position when the cutting unit cannot perform cutting at the current potential position, and setting the potential position where the cutting can be performed as the boarding pass length of one boarding pass of the medium.

A proposed second printer device prints and cuts each boarding pass from a series of boarding passes.

The second printer device includes: a feed amount storage unit for storing an amount of feed corresponding to a first boarding pass length of one boarding pass, and an amount of feed corresponding to a difference between the first boarding pass length and a second boarding pass length longer than the first boarding pass length of the one boarding pass; a conveyance unit for conveying the series of boarding passes to a cutting position; a cutter unit for attempting cutting by moving up and down a cutter with respect to the series of boarding passes; and a control unit.

The control unit conveys an end portion of the series of boarding passes by an amount of feed corresponding to the first boarding pass length stored in the feed amount storage unit from the position where the cutter unit is mounted by driving the conveyance unit, attempts a first cutting operation by the cutter unit on the series of boarding passes, and sets the boarding pass length of one boarding pass as the first boarding pass length when the first cutting operation is successfully performed.

Furthermore, when the first cutting operation is unsuccessfully performed, the control unit conveys the end portion of the series of boarding passes by the amount of feed corresponding to the difference stored in the feed amount storage unit by driving the conveyance unit, attempts the second cutting operation by the cutter unit, and sets the boarding pass length of one boarding pass as the second boarding pass length when the second cutting operation is successfully performed.

The drive torque of the cutter and the pressure to the medium by the conveyance unit are reduced such that the medium can be cut at the perforated position of the boundary between the boarding passes but cannot be cut at the non-perforated position so that the damage of the series of boarding passes (medium) can be reduced.

Therefore, when there are two types of boarding pass lengths for a series of boarding passes to be processed in a printer device (first boarding pass length of X1, and second boarding pass length of X2 (X2>X1)), the conveyance unit is driven to forward the end portion of the medium from the cutting position by the amount of feed corresponding to the first boarding pass length, and the cutting operation is attempted at the cutting position by moving the cutter up and down.

If the cutting operation is successfully performed, the length of one boarding pass length of a series of boarding passes to be processed is set as the first boarding pass length. If the cutting operation is unsuccessfully performed, the conveyance unit is driven to further forward the end portion of the medium by the amount of feed corresponding to the difference (=X2−X1) between the second boarding pass length (=X2) and the first boarding pass length (=X1), and the cutting operation is attempted at the cutting position by moving the cutter up and down. If the cutting operation is successfully performed, the length of one boarding pass of the series of boarding passes is set as the second boarding pass length. Thus, the cutting position can be controlled on the basis of the boarding pass length.

According to the present invention, in a device not loaded with a sensor for detecting the notched portion as a joint between a stub and a ticket or between tickets, the cutting position can be automatically controlled depending on the boarding pass length of a boarding pass, thereby solving the problem of displacing the correct cutting position of a boarding pass by an erroneous specification, and unsuccessfully printing characters etc. in correct positions.

DETAILED DESCRIPTION OF THE EMBODIMENTS

The details of the embodiments of the present invention are described below with reference to the attached drawings.

Figure 1:
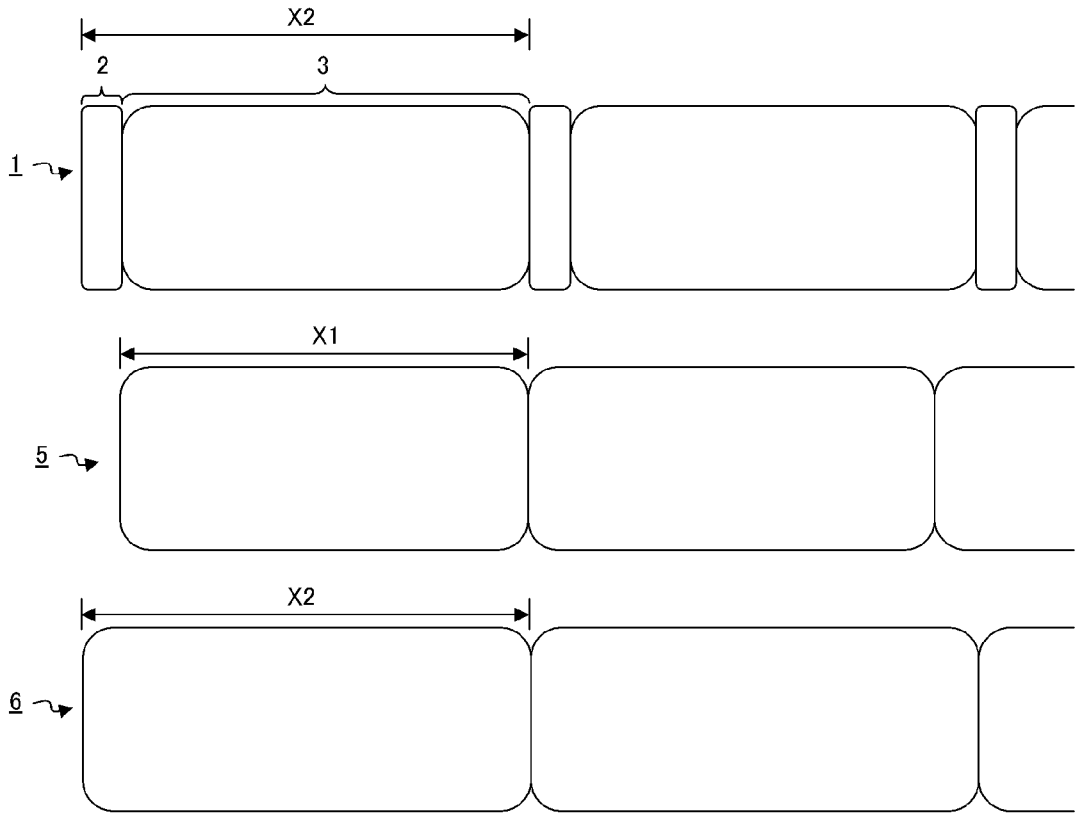
FIG. 1 illustrates a list of types of aircraft boarding passes.

FIG. 1 illustrates a list of types of aircraft boarding passes.

In FIG. 1, a boarding pass 1 is configured by a stub (marginal portion) 2, and a boarding pass body portion 3. The boarding pass length X2 of one boarding pass 1 is 8 inches.

A boarding pass 5 has no stub. The boarding pass length X1 of one boarding pass 5 is (7+⅜) inches.

A boarding pass having no stub in addition to the boarding pass 5 is a boarding pass 6. The boarding pass length of one boarding pass 6 is X2, that is, 8 inches.

Described below in the present embodiment is the control of the cutting position by setting the boarding pass length depending on the type of boarding pass when a printing process is performed on the boarding pass 1 or the boarding pass 5 using the printer device for printing a boarding pass (hereinafter referred to as a "ticket-issuing printer"). As clearly illustrated in FIG. 1, the cutting position is similarly controlled between the boarding pass 6 and the boarding pass 5.

Figure 2:
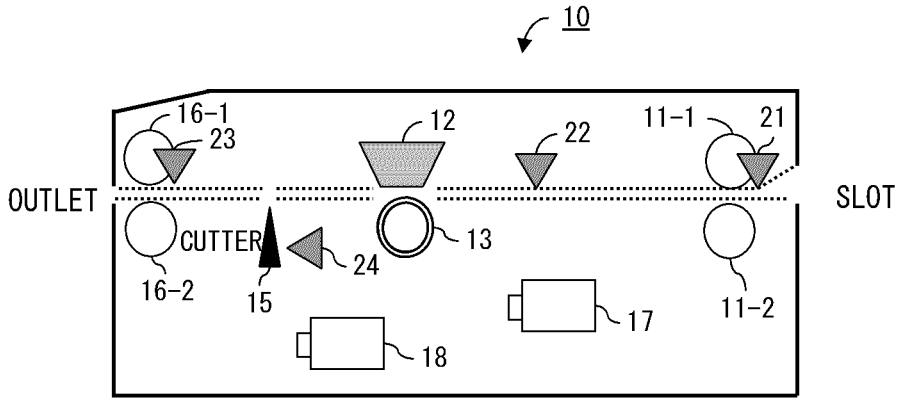
FIG. 2 is a sectional view of the configuration of the ticket-issuing printer.

FIG. 2 is a sectional view of the configuration of the ticket-issuing printer. In the following description, a plurality of boarding passes piled as a series of boarding passes before printing characters on can be referred as a medium.

As shown in FIG. 2, a ticket-issuing printer 10 is configured by a pair of entry rollers 11-1 and 11-2 provided at the slot of a medium, a printing head 12 for printing on the medium, a platen roller 13 provided at the position opposite the printing head 12, a cutter 15 for touching the medium and cutting the medium as necessary by up-and-down movement in a predetermined range including the position of the medium by the rotation of the mechanism not illustrated in FIG. 2, and a pair of exit rollers 16-1 and 16-2 provided at the outlet of the medium.

In FIG. 2, a medium conveyance motor 17 rotates each roller to convey a medium from the slot of the ticket-issuing printer 10 to the outlet. A cutter drive motor 18 moves the cutter 15 up and down.

A sensor 21 detects whether or not a medium has been set at the slot.

A sensor 22 provided at a reference position detects the time when the end of the medium passes the position, and the time when the printing process is started on the medium and the time when the up-and-down movement of the cutter 15 is started to cut the medium are determined on the basis of the detected time with the conveying speed taken into account. In this respect, the sensor 22 is called a reference sensor for a printing start position and a cutting position.

A sensor 23 detects whether or not the medium has been ejected (discharged) from the outlet of the ticket-issuing printer 10.

A sensor 24 detects the timing of the up-and-down movement of the cutter 15. The sensor 24 is a light transmission sensor as described later with reference to FIGS. 7 and 9.

Figure 4:
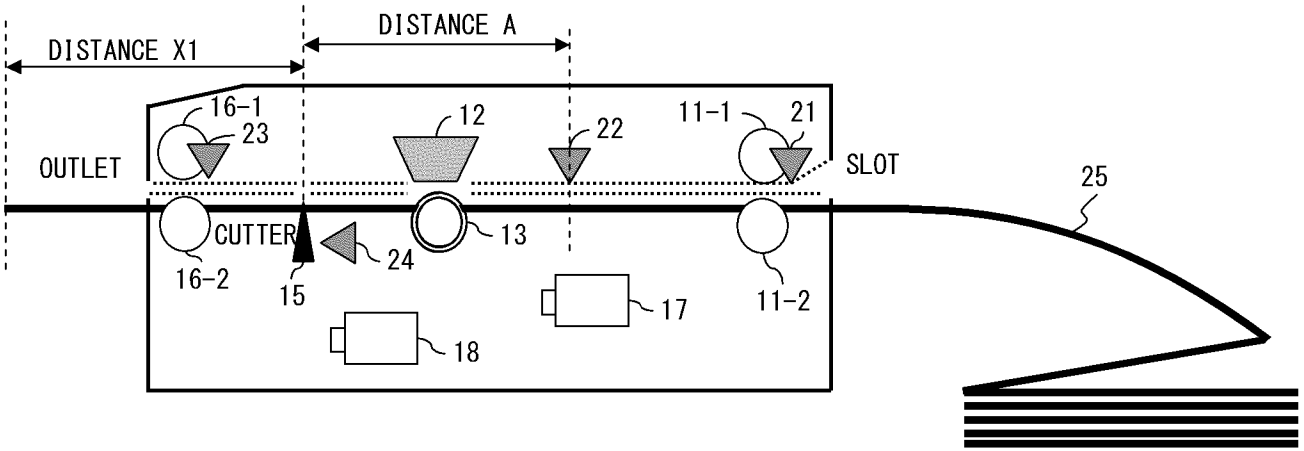
FIG. 4 is a sectional view of an ticket-issuing printer in a state in which a medium is conveyed to the first cutting position.

In the present embodiment, as illustrated in FIGS. 1 and 4, a series of boarding passes has the perforation for easy cutting at the boundary between boarding passes, and the series of boarding passes can be folded at the perforation and piled with character strings etc. of necessary data not yet printed. Then, the end portion of the piled series of boarding passes is inserted from the slit of the ticket-issuing printer 10.

Figure 3:
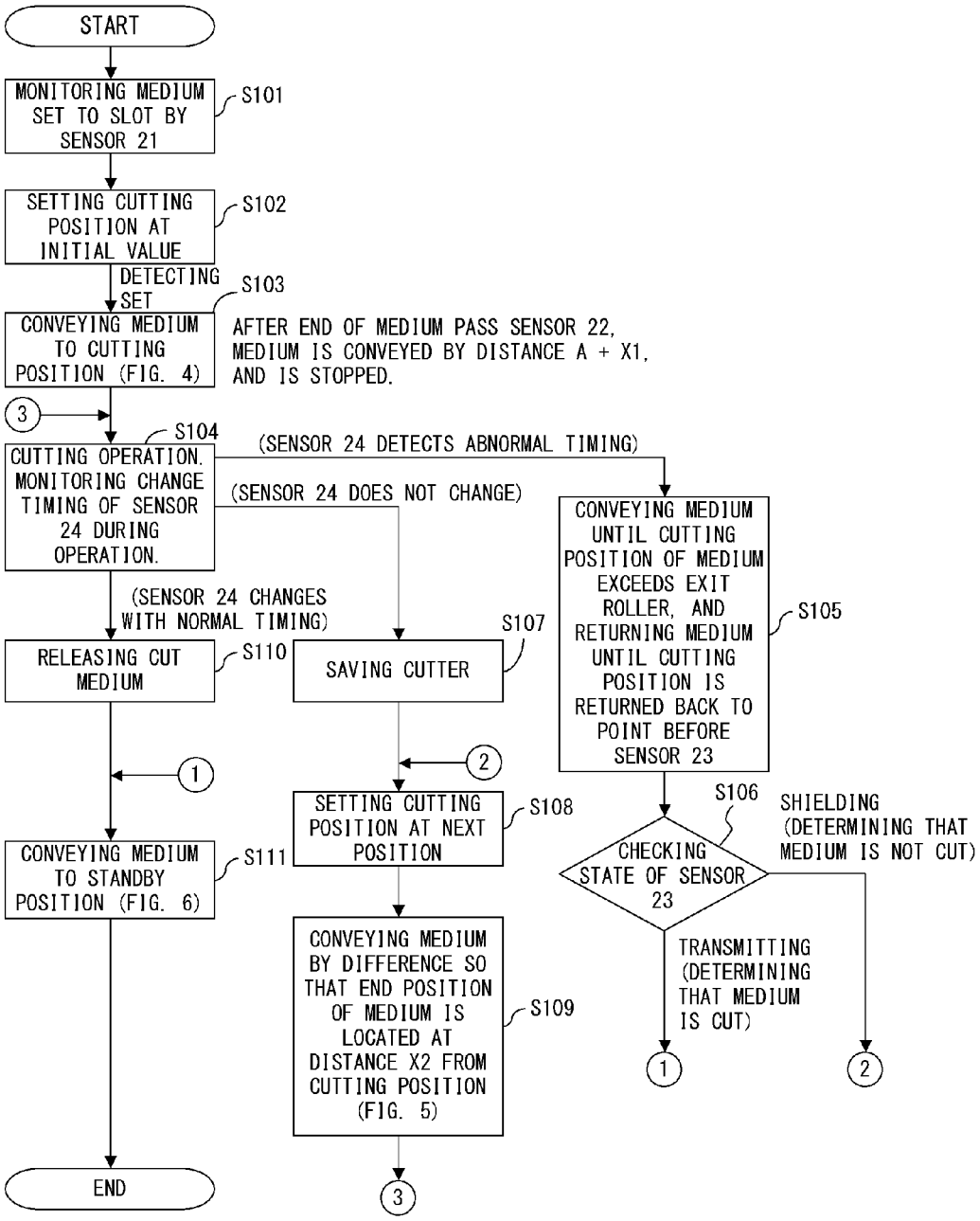
FIG. 3 is a flowchart of the process of setting a boarding pass length of one boarding pass in a series of boarding passes.

FIG. 3 is a flowchart of the process of setting a boarding pass length of one boarding pass in a series of boarding passes.

In step S101 illustrated in FIG. 3, the sensor 21 provided near the slit of the ticket-issuing printer 10 monitors whether or not a medium has been input to the slit.

So far as a set of medium has been detected, the monitoring process in step S101 is continued.

When the set of medium is detected in step S101, a cutting position is set to an initial value in step S102.

In this flowchart, it is assumed that one of the boarding pass having a boarding pass length of 8 inches and the boarding pass having a boarding pass length of (7+⅜) inches is piled as a series of boarding passes at the slot of the ticket-issuing printer 10 as described later with reference to FIG. 4. The medium is cut at the intervals equal to the boarding pass length of the piles boarding passes by performing the processes in the flowchart, and the printing process is performed on the medium without displacement. The flowchart includes the processes from setting an appropriate boarding pass length for the medium to setting the end position of the boarding pass (medium) at a standby position.

The initial value of the cutting position in step S102 refers to the amount of feed corresponding to the minimum value of the boarding pass length ((7+⅜) inches in this example). The "next position for the cutting position" in step S108 described later refers to the amount of feed corresponding to the difference (⅝ inch in this example) between the second smallest boarding pass length (8 inches in this example) and the smallest boarding pass length ((7+⅜) inches in this example).

In step S103 after step S102, as illustrated in FIG. 4, the medium is conveyed to the cutting position. To be more exact, the medium is conveyed by the amount of feed obtained by adding the amount of feed corresponding to the distance (expressed by the "distance A" in FIG. 4) from the reference position where the sensor 22 is mounted to the mounting position of the cutter 15 and the amount of feed set in step S102 with reference of the position of the sensor 22. As a result, as illustrated in FIG. 4, the medium overruns by the distance X1 (=(7+⅜) inches) from the mounting position of the cutter 15 to the left side of the ticket sheet.

In step S104 after step S103, the cutter drive motor 18 is driven as described above, and the mechanism not illustrated in the attached drawings is rotated, thereby moving up and down the cutter 15 including the medium position, and attempting the cutting operation on the medium. The timing of the cutting operation is monitored (detected) by the sensor 24.

The drive torque of the cutter 15, the pressure to the medium by the entry rollers 11-1 and 11-2, the pressure to the medium by the pair of exit rollers 16-1 and 16-2, and the pressure to the medium by the printing head 12 and the platen roller 13 positioned opposite the printing head 12 are adjusted in advance such that the medium can be cut at the perforated position of the boundary between the boarding passes but cannot be cut at the non-perforated position so that the damage of the series of boarding passes (medium) can be reduced.

Then, the time required to start raising the cutter 15 and lower it to the original position when the cutter is moved up and down at the position of the perforation of the medium is statistically measured, a predetermined margin is added as necessary, and the range of the time required to return to the original position (T1<time required to return<T2, that is, T1 and T2) is stored in the memory as "normal timing".

In addition, as a result of practically attempting a cutting operation on the medium by the up-and-down movement of the cutter 15 at the position out of the perforation of the medium, it is proved that there are three cases, that is, the case in which the cutter is returned to the original position earlier than the normal timing depending on the engagement between the medium and the cutter 15 (T1>time required to return), the case in which the cutter is returned to the original position later than the normal timing (T2<time required to return<T3 which is described later) (these two cases are hereinafter referred to collectively as "abnormal timing"), and the case in which the cutter 15 is engaged in the medium and cannot be returned to the original position in an assumed time (T3) (time required to return>T3) (hereinafter referred to as "the sensor 24 does not detect a change"). Also, it is proved that there are some cases the medium is cut when the sensor 24 detect "abnormal timing".

The process in step S104 in each case after step S103 branches as follows.

That is, in step S104 after step S103, when the sensor 24 detect the "abnormal timing", the medium is conveyed until the position in which a cutting operation is attempted on the medium in step S105 is ahead of the exit rollers 16-1 and 16-2 (leftward on the ticket sheet illustrated in FIG. 4), and the medium is conveyed in the reverse direction until the position in which the cutting operation is attempted on the medium is before the sensor 23.

Thus, when the medium is cut, there is no medium to the left of the new end position of the medium which is returned to the point before the sensor 23 on the ticket sheet in FIG. 4. Therefore, in step S106 after step S105, it is determined whether or not the light output by the sensor 23 can be transmitted, thereby determining whether or not the medium is cut.

If it is determined in step S106 that the light output by the sensor 23 can be transmitted, control is passed to step S111. If it is determined in step S106 that the light output by the sensor 23 has been shielded by the medium, then the control is passed to step S108.

Figure 5:
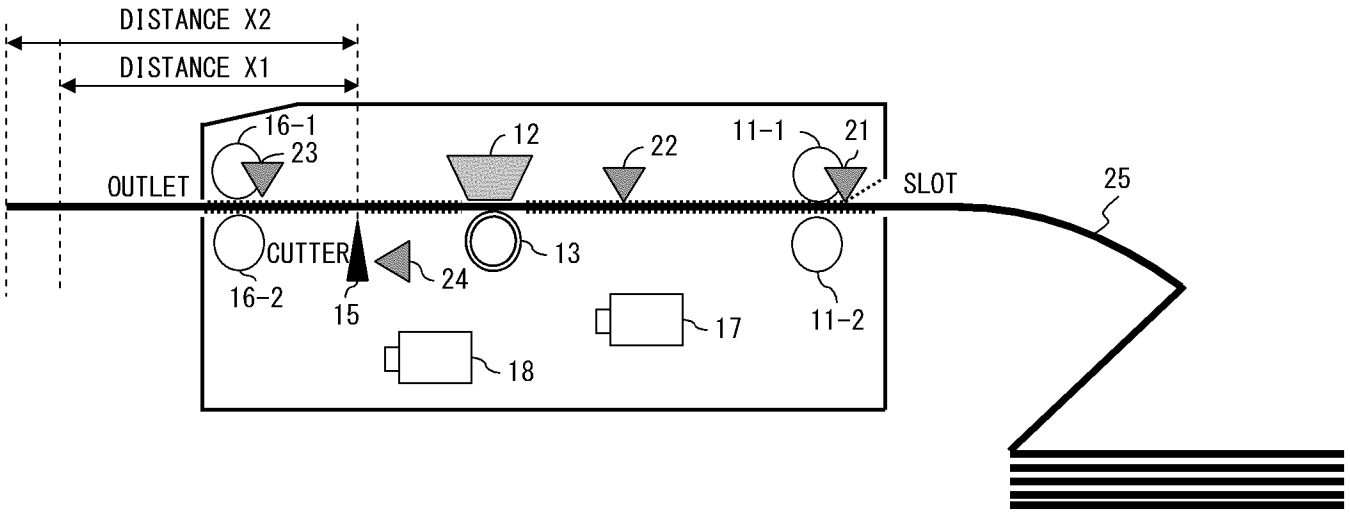
FIG. 5 is a sectional view of the ticket-issuing printer on which a medium is conveyed by a difference from the first cutting position to the second cutting position.

On the other hand, in step S104 after step S103, if the "sensor 24 has not detected a change", then the cutter 15 is saved and returned to the original position in step S107. Then, in step S108 after step S107 or step S106 (when the light of the sensor 23 is shielded), the next position is set as the cutting position. In step S109, the medium is conveyed by the amount of amount of feed corresponding to the difference X2−X1 (=⅝ inch) between the distance X2 (=8 inches) and the distance X1 (=(7+⅜) inches) such that the end position of the medium can be at the distance X2 (=8 inches) from the mounting position of the cutter as illustrated in FIG. 5, and control is passed to step S104. The process in step S104 in which control is passed from step S109 is described later.

Figure 6:
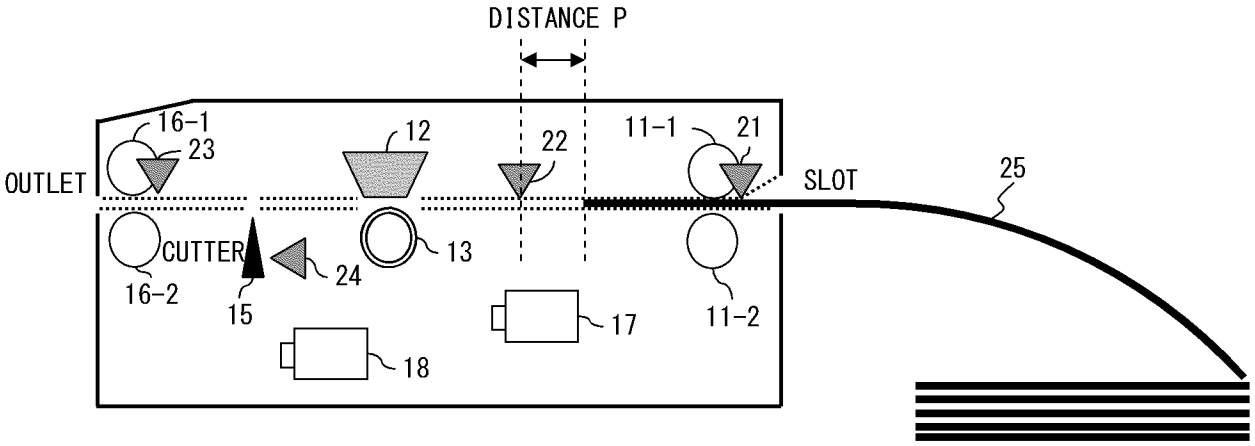
FIG. 6 is a sectional view of the ticket-issuing printer on which a medium is set in a correct set position.

In step S104 after step S103, if the sensor 24 detects the "normal timing", a cut medium, that is, a boarding pass, is ejected (released) from the outlet of the ticket-issuing printer 10 in step S110. In step S111 after step S110 or step S106 (when the light of the sensor 23 is transmitted), the boarding pass length of one boarding pass of the medium to be processed is set as the amount of feed corresponding to the first boarding pass length X1 (=(7+⅜) inches), and the medium is conveyed to the standby position (before the sensor 22 by the distance P in FIG. 6) as illustrated in FIG. 6, thereby terminating a series of processes.

Described next is the process in step S104 from step S109.

In step S104 after step S109, the cutting operation is attempted on the medium by the up-and-down movement of the cutter 15 including the medium position.

In the present embodiment, since the boarding pass length of one boarding pass is X1 (=7+⅜) inches) or X2 (=8 inches) the cutting operation in step S104 after step S109 is to be normally successfully performed except when there occurs any irregular condition.

In step S110 after step S104, a cut medium, that is, a boarding pass, is ejected (released) from the outlet of the ticket-issuing printer 10. Then, in step S111 after step S110 or step S106 (when the light of the sensor 23 is transmitted) the boarding pass length of one boarding pass of the medium to be processed is set as the amount of feed corresponding to the second boarding pass length X2 (=8 inches), and simultaneously, as illustrated in FIG. 6, the medium is conveyed to the standby position (in FIG. 6, the standby position is located at the distance P before the sensor 22), thereby terminating a series of processes.

Figure 7:
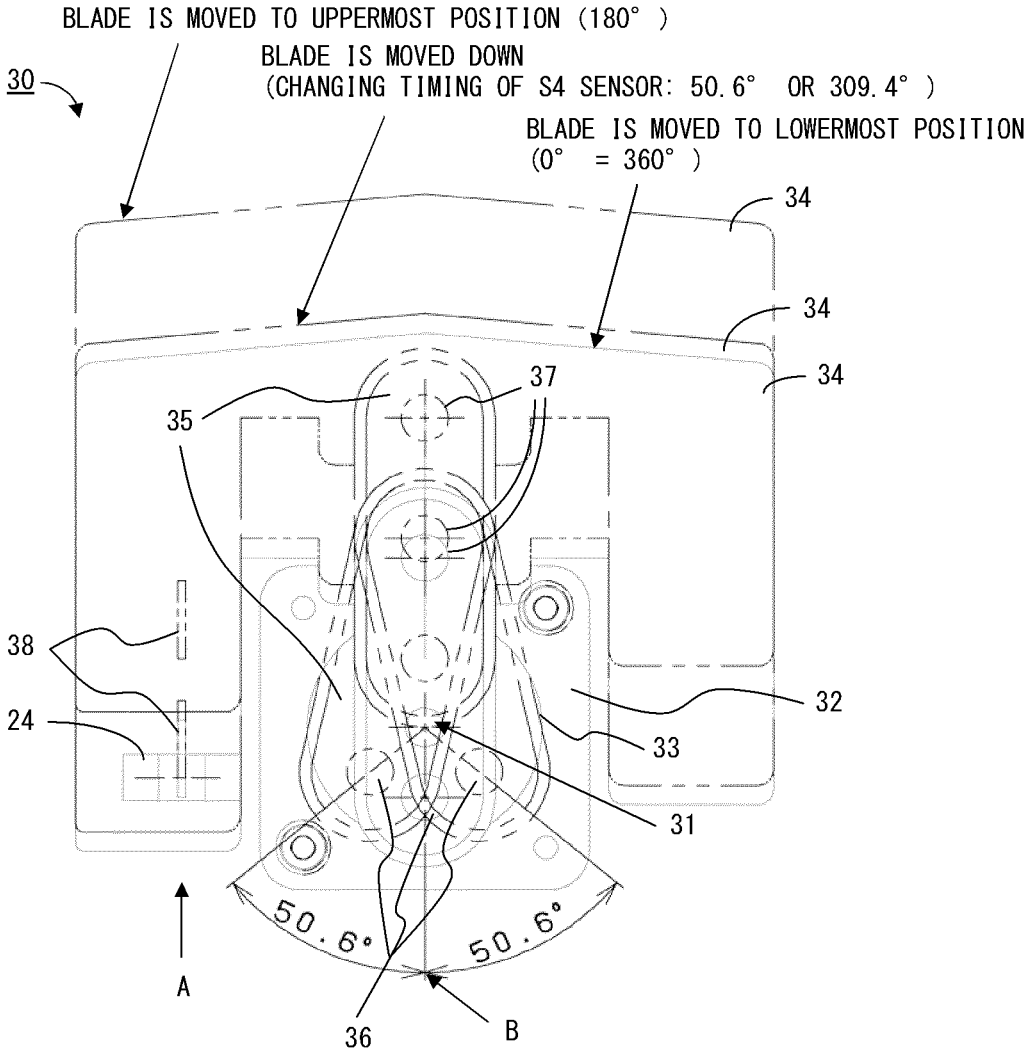
FIG. 7 illustrates the details of the structure of the cutting unit.

FIG. 7 illustrates the details of the structure of the cutting unit.

In FIG. 7, a cutting unit 30 includes a motor 32 having a motor axis 31 to drive a cutter 34, a disk 33 attached to the motor axis 31 of the motor 32, the cutter 34 whose ends are guided to be moved up and down to cut a medium as a series of boarding passes, a long coupling member 35 fixed to the disk 33 as rotatable on a first coupling unit 36, and fixed to the cutter 34 as rotatable on a second coupling unit 37, the light transmission sensor 24 whose photo-receptive unit receives the light output by a light emission unit, and a shielding plate 38 mounted vertically to the plane formed by the cutter 34, and shielding the light output from the light emission unit of the light transmission sensor 24 to the photo-receptive unit.

Although the positions of the cutter 34, the coupling member 35, and the shielding plate 38 that move with time by the up-and-down movement of the cutter 34 are displayed as overlapping one another in FIG. 7, there are one cutter 34, one coupling member 35, and one shielding plate 38. As illustrated in FIG. 7, the angle is made by the vertical direction and the direction from the motor axis 31 to the first coupling unit 36.

Figure 8:
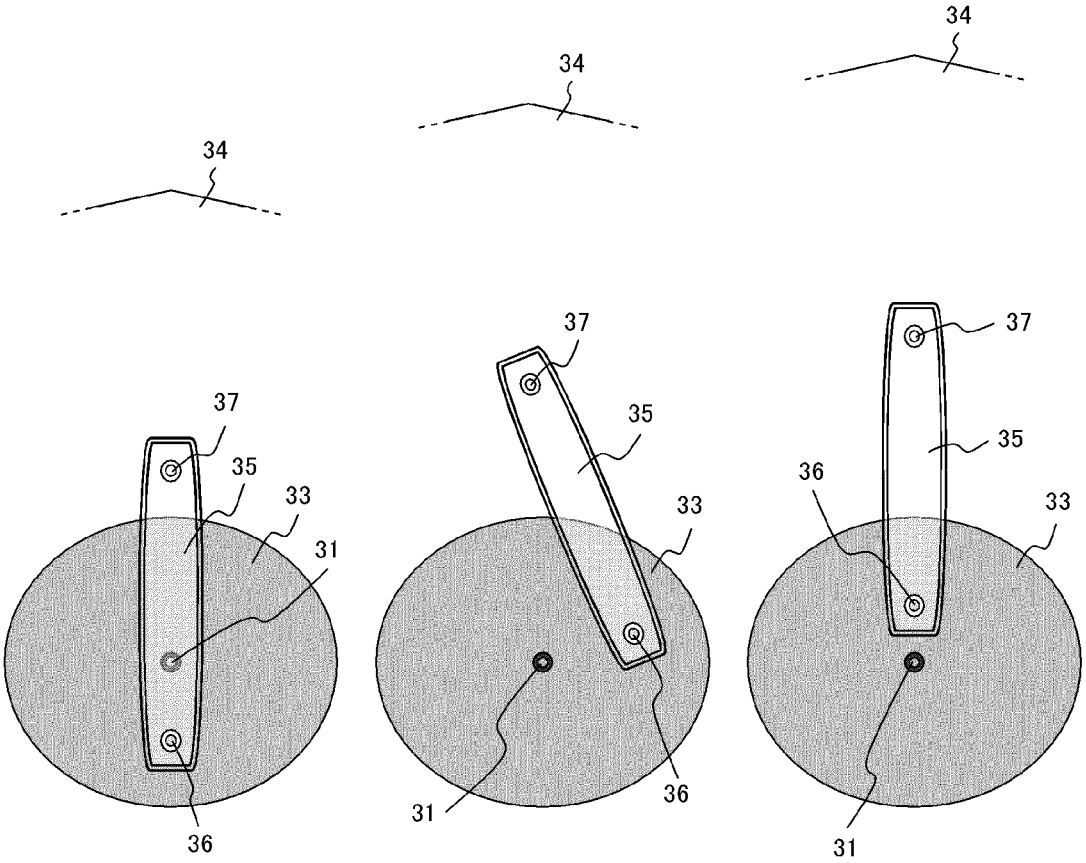
FIG. 8 is a view illustrating the disk rotating by the rotation of the motor, and the cutter moving up and down.

FIG. 8 is a view illustrating the disk rotating by the rotation of the motor, and the cutter moving up and down.

The view on the left of FIG. 8 illustrates the cutter 34 at the lowest position in the vertical direction. In this position, the direction of the longer side of the coupling member 35 matches the vertical direction of the movement of the cutter 34, and the second coupling unit 37 of the coupling member 35 is located closest to the motor axis 31.

By the disk 33 rotating with the rotation of the motor 32, the coupling member 35 swings about the center of the rotation of the second coupling unit 37, and the cutter 34 is slightly lifted vertically as illustrated on the center of FIG. 8.

As illustrated on the right of FIG. 8, when the cutter 34 is at the highest position in the vertical direction, the direction of the longer side of the coupling member 35 matches the vertical direction of the movement of the cutter 34. In this case, the second coupling unit 37 of the coupling member 35 is farthest from the motor axis 31.

Figure 9A:
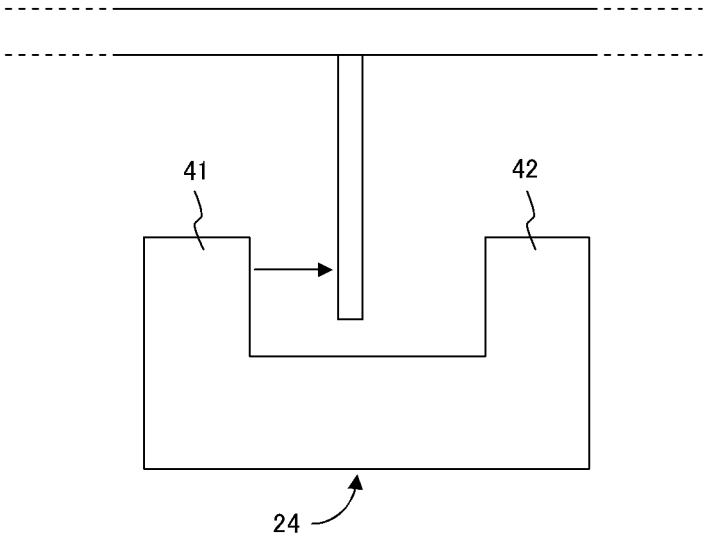
FIG. 9A is a view (1) of the light transmission sensor and the shielding plate viewed from the direction of the arrow A illustrated in FIG. 7.
Figure 9B:
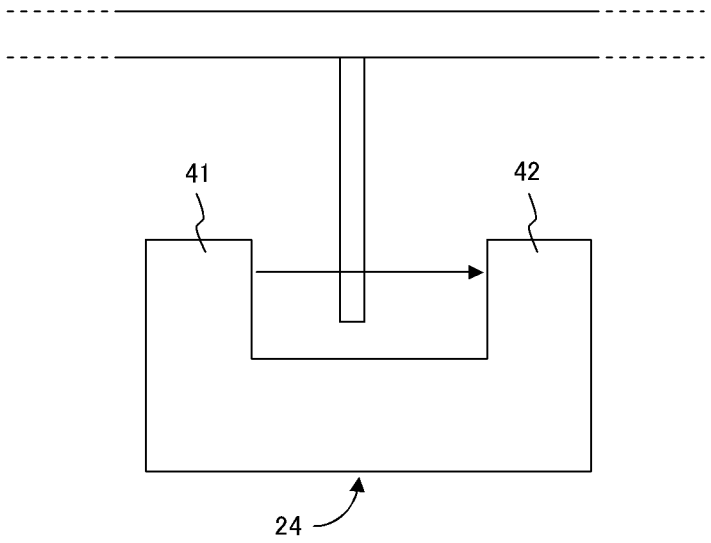
FIG. 9B is a view (2) of the light transmission sensor and the shielding plate viewed from the direction of the arrow A illustrated in FIG. 7.

FIGS. 9A and 9B are views of the light transmission sensor and the shielding plate viewed from the direction of the arrow A illustrated in FIG. 7.

With reference to the position in which the direction of the longer side of the coupling member 35 matches the vertical direction of the movement of the cutter 34, and the second coupling unit 37 of the coupling member 35 is closest to the motor axis 31 as illustrated by the arrow B in FIG. 7, the shielding plate 38 is located between a light emission unit 41 of the light transmission sensor 24 and a photo-receptive unit 42 as viewed toward the depth of the sheet as illustrated in FIG. 9A in the range in which the direction from the motor axis 31 to the second coupling unit 37 makes the angle of 50.6° with the vertical direction of the movement of the cutter 34 both clockwise or counterclockwise, and the light output from the light emission unit 41 is not received by the photo-receptive unit 42.

On the other hand, when the angle made by the direction from the motor axis 31 to the second coupling unit 37 and the vertical direction of the movement of the cutter 34 is out of the range within 50.6° clockwise or counterclockwise, the shielding plate 38 is not located between the light emission unit 41 and the photo-receptive unit 42 of the light transmission sensor 24 as viewed toward the depth of the sheet as illustrated in FIG. 9B, and the light output from the light emission unit 41 is received by the photo-receptive unit 42.

That is, the light transmission sensor 24 detects one up-and-down movement by the cutter 34 from the time when the cutter 34 deviates from the range of 50.6° clockwise or counterclockwise after the starting time of the up-and-down movement until it returns within the range.

Adjusting the drive torque of the cutter and the pressure to the series of boarding passes by the conveyance unit such that the series of boarding passes can be cut at the perforated position of the boundary between the boarding passes but cannot be cut at the non-perforated position so that the damage of the series of boarding passes can be reduced can be realized as follows. The motor 32 is a stepping motor, and the speed is represented by the number of pulses (pps, that is, pulse per second) for a switch of the layers for moving the motor in one second.

(1) The motor torque in the operation mode (provisional cutting) for setting an appropriate boarding pass length on the medium is set lower than the motor torque in the normal cutting operation (practical cutting) for the set boarding pass length.

example: in provisional cutting: 100% output
in practical cutting: 141% output (2) An out-of-tune (idling) motor occurs when the pressure load of the cutter to the medium is large by roughly setting the process of the accelerated slewing at the activation of the motor in the provisional cutting operation.

example: The pps displacement of the final portion of the accelerated slewing is:

smooth in practical cutting: 1144 pps→1241 pps→1250 pps (gradually reaching the top speed); and
rough in provisional cutting: 1250 pps→2500 pps→5000 pps (rapidly reaching the top speed).

In the practical cutting and the provisional cutting, the stationary speed (top speed), the initial speed, and the slewing are set as follows.

For practical cutting operation:
stationary speed: 1250 pps
initial speed: 645 pps
slewing: 645 pps→795 pps→925 pps→1040 pps→1144 pps→1241 pps→1250 pps For provisional cutting operation:
stationary speed: 5000 pps
initial speed: 400 pps
slewing: 400 pps→920 pps→1290 pps→1590 pps→1848 pps→2079 pps→2288 pps→2481 pps→1250 pps→2500 pps→5000 pps Then, the variance of time from when the deviation from the range of 50.6° clockwise or counterclockwise detected by the light transmission sensor 24 to when the range is entered again is measured when the cutting operation is performed at the perforation among the boarding passes, and the variance is stored in the memory of the printer device as a first time range (corresponding to the above-mentioned "normal timing"), and the time in which the out-of-tune (idling) motor occurs is measured, and the time is stored in the memory of the printer device as a second time (exceeding the first time range) (corresponding to the case where "the sensor 24 does not detect a change").

Then, the case in which the light transmission sensor 24 detects that the cutter 34 has returned to the original position in the first time range from the starting time of the up-and-down movement of the cutter 34 to perform the cutting operation of the cutting unit 30 is defined as a successful medium cutting by the cutter 34, and the case in which the light transmission sensor 24 detects that the cutter 34 has not returned to the original position by the second time from the starting time of the up-and-down movement of the cutter 34 to perform the cutting operation of the cutting unit 30 is defined as an unsuccessful medium cutting by the cutter 34.

When the light transmission sensor 24 detects that the cutter 34 has returned to the original position not within the first time range from the starting time of the up-and-down movement of the cutter 34 for performing the cutting operation of the cutting unit 30, and before the second time exceeding the first time range, there can be a successful medium cutting or an unsuccessful medium cutting. In this case, the success or failure of the medium cutting is determined in the method of using another sensor as described above with reference to the flowchart in FIG. 3.

What is claimed is:

1. A printer device which prints and cuts each boarding pass from a series of boarding passes, comprising:

a feed amount storage unit storing a first amount of feed corresponding to a first boarding pass length of one boarding pass, and a second amount of feed corresponding to a difference between the first boarding pass length and a second boarding pass length longer than the first boarding pass length of the one boarding pass;

a conveyance unit conveying the series of boarding passes to a cutting position;

a cutter unit performing a cut operation by pressing a cutter against the series of boarding passes and being returned to the original position; and a control unit reading the first amount of feed from the feed amount storage unit, the control unit driving the conveyance unit to convey an end portion of the series of boarding passes by the first amount of feed read from the feed amount storage unit from a position where the cutter unit is mounted, driving the cutter unit to perform a first cut operation on the series of boarding passes, determining whether or not one of the boarding passes has been cut off from the series of boarding passes, and setting the first boarding pass length as the length of the one of the boarding passes if it is determined that the one of the boarding passes has been cut off from the series of boarding passes.

2. The device according to claim 1, wherein a drive torque of the cutter and the pressure to the series of boarding passes by the conveyance unit are adjusted in advance such that the series of boarding passes can be cut at a perforated position of a boundary between a first boarding pass and a second boarding pass following the first boarding pass but cannot be cut at a non-perforated position so that damage of the series of boarding passes can be reduced.

3. The device according to claim 1, further comprising a detection unit detecting timing of the cutter unit performing a cut operation, wherein it is assumed that the first or second cut operation is successfully performed when the detection unit detects that the cutter has returned to an original position within a predetermined first time range from a starting point of an up-and-down movement of the cutter for performing a cut operation of the cutter unit.

4. The device according to claim 1, further comprising a detection unit detecting timing of the cutter unit performing a cut operation, wherein it is assumed that the first or second cut operation is unsuccessfully performed when the detection unit detects that the cutter has not returned to an original position by a predetermined second time from a starting point of an up-and-down movement of the cutter for performing a cut operation of the cutter unit.

5. The device according to claim 1, further comprising:

a first detection unit detecting timing of the cutter unit performing a cut operation; and a second detection unit provided near an outlet of the printer device, wherein:

when the first detection unit detects that the cutter has deviated from a predetermined first time range, and has returned to an original position from a starting point of an up-and-down movement of a cutter for performing the first or second cut operation of the cutter unit by a predetermined second time exceeding the first time range, the control unit first drives the conveyance unit to convey a position of the series of boarding passes on which a cut operation is performed until the position is ejected from an outlet of the printer device, and returns the position on which the cut operation of the series of boarding passes was performed to the point before a second detection unit provided near the outlet of the printer device;

when light output by the second detection unit is transmitted, it is assumed that the first or second cutting operation has been successfully performed; and when light output by the second detection unit is shielded, it is assumed that the first or second cutting operation has been unsuccessfully performed.

6. The printer device of claim 1, comprising:

reading the second amount of feed from the feed amount storage unit if it is determined that the one of the boarding passes is not cut off from the series of boarding passes, driving the conveyance unit to convey the end portion of the series of boarding passes by the second amount of feed from the feed amount storage unit, driving the cutter unit to perform a second cut operation, determining whether or not the one of the boarding passes has been cut off from the series of boarding passes, and setting the boarding pass length of the one boarding pass to the second boarding pass length if it is determined that the one of the boarding passes has been cut off from the series of boarding passes.

* * * * *